US006233894B1

(12) United States Patent
Abney et al.

(10) Patent No.: US 6,233,894 B1
(45) Date of Patent: May 22, 2001

(54) GUARDRAIL SYSTEM FOR AN APPARATUS MOVABLE ALONG A ROOF STRUCTURE

(75) Inventors: Ernest Craig Abney, Deltona, FL (US); Don Albert Neifer, Granville, OH (US); Dennis K. Wenrick, Santa Rosa Beach, FL (US); Clinton Alan Plant, San Antonio, TX (US)

(73) Assignee: Owens Corning Fiberglas Technology, Inc., Summit, IL (US)

( * ) Notice: Subject to any disclaimer, the term of this patent is extended or adjusted under 35 U.S.C. 154(b) by 0 days.

(21) Appl. No.: 09/223,335

(22) Filed: Dec. 30, 1998

(51) Int. Cl.[7] ..... E04D 15/06; E04G 21/14

(52) U.S. Cl. ..... 52/506.01; 52/745.13; 52/749.12; 52/DIG. 12

(58) Field of Search ..... 52/749.12, 745.13, 52/DIG. 12, 506.01; 182/113

(56) References Cited

U.S. PATENT DOCUMENTS 3,880,405 * 4/1975 Brueske ..... 182/113 X
3,983,676 10/1976 Gilpin .
3,992,847 * 11/1976 Heath ..... 52/749.12 X
4,967,535 11/1990 Alderman .
5,249,759 * 10/1993 Griek et al. ..... 182/113 X
5,251,415 10/1993 Van Auken et al. .
5,653,081 8/1997 Wenrick et al. .
5,884,449 * 3/1999 Alderman et al. ..... 52/407.4 X

* cited by examiner

*Primary Examiner*—Christopher T. Kent
(74) *Attorney, Agent, or Firm*—Inger H. Eckert; Stephen W. Barns

(57) ABSTRACT

A guardrail assembly movable along a roof structure is disclosed. The guardrail assembly is used in cooperation with a roof structure having a plurality of purlins spaced apart from one another in a parallel arrangement and sheets of roofing material fastened to the purlins. The sheets have ends which define an edge of the roof structure extending in a first direction. The guardrail assembly is movable along the roof structure in the first direction. The guardrail assembly includes a railing positioned above the sheets of roofing material and extends generally in the first direction.

20 Claims, 3 Drawing Sheets

GUARDRAIL SYSTEM FOR AN APPARATUS MOVABLE ALONG A ROOF STRUCTURE

TECHNICAL FIELD AND INDUSTRIAL APPLICABILITY OF THE INVENTION

This invention relates to the construction of an insulated metal roof structure for use in commercial and industrial buildings.

BACKGROUND OF THE INVENTION

Metal roof structures typically comprise a series of parallel rafter beams extending across the building in one direction, and purlin beams parallel to each other mounted on top of the rafters extending in a direction normal to the rafters. Insulation material in long blankets is placed in the area between purlins. The blankets of insulation material can be laid along the length of the purlins or across the purlins in a direction normal to the purlins. If desired, the roof structure can have a first layer of insulation material which is laid along the length of the purlins, and a second layer of insulation material which is laid laterally across the purlins on top of the first layer of insulation. Sheets of hard roofing material such as metal decking are then attached on top of the purlins over the insulation material. Because the hard roofing material comes in long sheets and the roofs generally have two sloped sections, it is customary to construct the roof along the length of the structure from one end to the other. The workers stand on the previously laid section of the roof to construct the next section.

The insulation material is supported between the purlins beneath the hard roofing material. Various methods of supporting the insulation material have been used. Mounting straps or wire mesh, which are attached to or draped over the purlins forming a lattice, have been used. This is referred to as banding. A support sheet, typically made of vinyl and acting as a vapor barrier, is then rolled onto the lattice, and insulation material is placed between adjacent purlins and over the support sheet. If the installation of the lattice is done from underneath the roof structure, scaffolding or lifting equipment is typically required for installation. Since the lattice encompasses the entire roof, installation is costly and time consuming. Once the hard roofing material is mounted on the purlins, the support sheet can support the insulation material and the lattice no longer serves any useful purpose.

Some systems dispense with the lattice and use the support sheet itself to support the insulation material. The support sheet is dispensed from a roll and draped from adjacent purlins. Insulation material is then placed on top of the support sheet. A carriage, such as that disclosed in U.S. Pat. No. 4,967,535 to Alderman, has been used to aid in the dispensing of the support sheet. The carriage is positioned on top of the purlins and travels in a downstream direction along the length of the purlins during the roof construction. A roll of the support sheet material is mounted on the carriage and the support sheet is dispensed from the roll and placed on top of the purlins. As the carriage travels in the downstream direction, the support sheet is draped across the purlins.

The carriage can be any length up to the width of the roof itself. For example, the carriage can be comprised of a plurality of carriage sections which are joined together so that they span the entire width of the roof. Each carriage section has a roll or a plurality of rolls of support sheet which are dispensed as the carriage travels along the purlins. Preferably, the support sheets are provided with a width appropriately sized so that the support sheet extends between two adjacent purlins. The carriage is then propelled along the length of the purlins so that the carriage sections move in unison.

The carriage can also include a walking platform for workers to stand and walk on during the construction of the roof, such as that disclosed in U.S. Pat. No. 5,653,081 to Wenrick et al. The platform is about a meter wide and extends in a direction normal to the length of the purlins. Each carriage section has a platform section extending the entire width of the carriage section so that when the carriage sections are joined together, a continuous platform is formed. The platform is positioned above the purlins and downstream from the support sheet rolls and the last completed section of the roof. The platform has a railing on the downstream edge thereof, to function as a barrier for the workers from the exposed portion of the roof structure in which the sheets of hard roofing material have not been installed. The carriage sections at the ends of the carriage can have a smaller railing extending across the width of the platform to function as a barrier for the ends of the platform.

Workers can stand on top of the fastened sheets of roofing material which are upstream of the carriage. To protect the workers near the lateral edge of the roof structure, the workers are typically tied off with lines, such as rope or cable, to a portion of the roof structure to prevent them from falling entirely off of the roof structure. Although tying off workers sufficiently protects the workers, the lines can interfere with and be tangled up with the insulation, roofing material, and/or other lines. It is also cumbersome to re-tie the lines as the completed section of the roof advances. Alternatively, a warning line can be set up a distance from the lateral edge of the roof structure, to warn the workers that they are approaching the edge of the roof structure. A temporary barrier, such as a railing may also be set up a distance from the lateral edge of the roof structure. Although the warning lines and temporary barriers are sufficient to warn the workers in the middle of the roof structure, they do not protect the workers who are constructing the roof at the immediate lateral edges of the roof structure.

It would be desirable to have an apparatus and method for safely providing a barrier for the workers working adjacent the lateral edge of a roof structure, which is simple and easy to use and does not interfere during the construction process.

SUMMARY OF THE INVENTION

The above objects as well as other objects not specifically enumerated are achieved by a guardrail assembly and method of using the same to help protect workers on top of a roof structure. The guardrail assembly is used in cooperation with a roof structure having a plurality of purlins spaced apart from one another in a parallel arrangement. Sheets of roofing material are fastened to the purlins. The sheets have ends which define an edge of the roof structure extending in a first direction. The guardrail assembly is movable along the roof structure in the first direction. The guardrail assembly includes a railing positioned above the sheets of roofing material and extends generally in the first direction.

The method of the present invention includes providing a roof structure having a plurality of purlins spaced apart from one another in a parallel arrangement and extending in a first direction. A carriage is also provided upon which is mounted a roll of support sheet. The support sheet has side edges which are generally aligned with top portions of adjacent purlins. A guardrail assembly is also provided. The guardrail assembly is attached to the carriage and includes a railing extending in the first direction. A first section of the roof structure is then completed. The roof structure includes purlins, the support sheet, insulation material placed on top of the support sheet, and a first sheet of roofing material fastened to the purlins. The railing is positioned above the first sheet of roofing material. The carriage and the guardrail assembly are moved along the length of the purlins in a direction away from the completed first section of the roof structure. A second section of the roof structure is then completed. The second section includes purlins, the support sheet, insulation material placed on top of the support sheet, and a second sheet of roofing material fastened to the purlins, adjacent the first section of the roof structure.

Various objects and advantages of this invention will become apparent to those skilled in the art from the following detailed description of the preferred embodiment, when read in light of the accompanying drawings.

DETAILED DESCRIPTION AND PREFERRED EMBODIMENTS OF THE INVENTION

Figure 4:
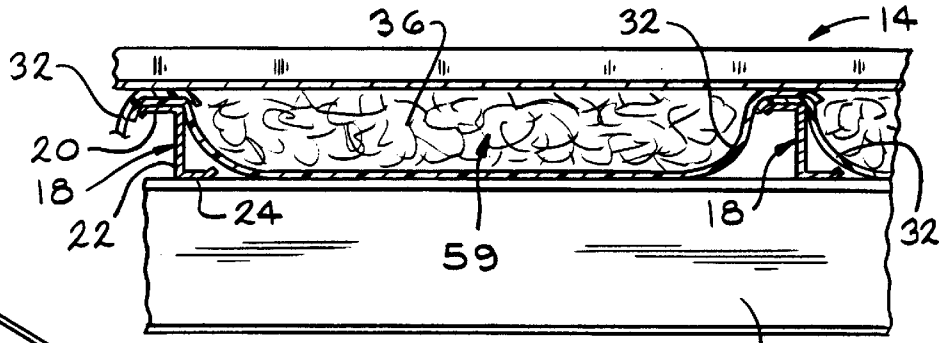
FIG. 4 is a schematic sectional view of the roof structure taken along Lines 4—4 of FIG. 2.
Figure 1:
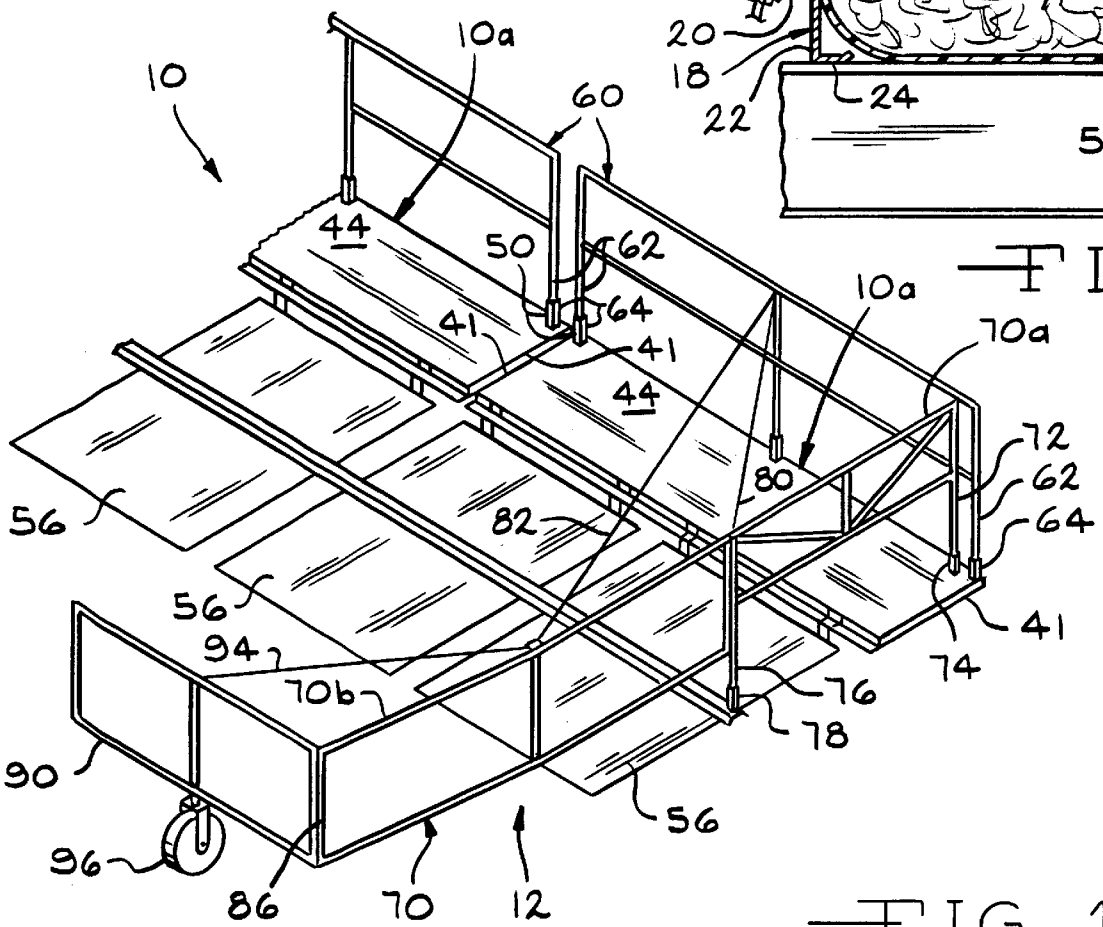
FIG. 1 is a schematic perspective view of a portion of a carriage including a perimeter guardrail, in accordance with the present invention.
Figure 2:
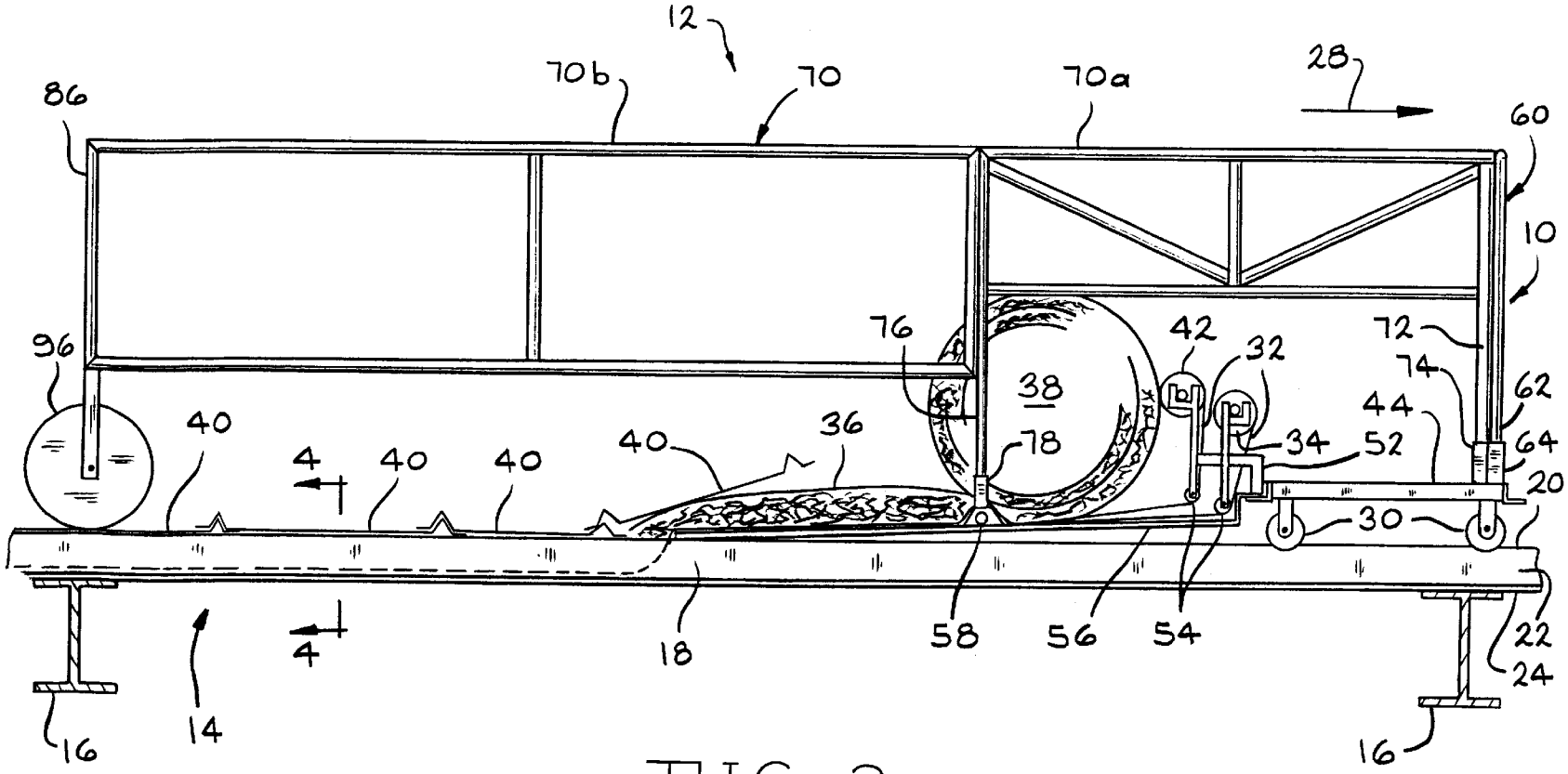
FIG. 2 is a schematic elevational side view of the carriage of FIG. 1 on top of a roof structure.
Figure 3:
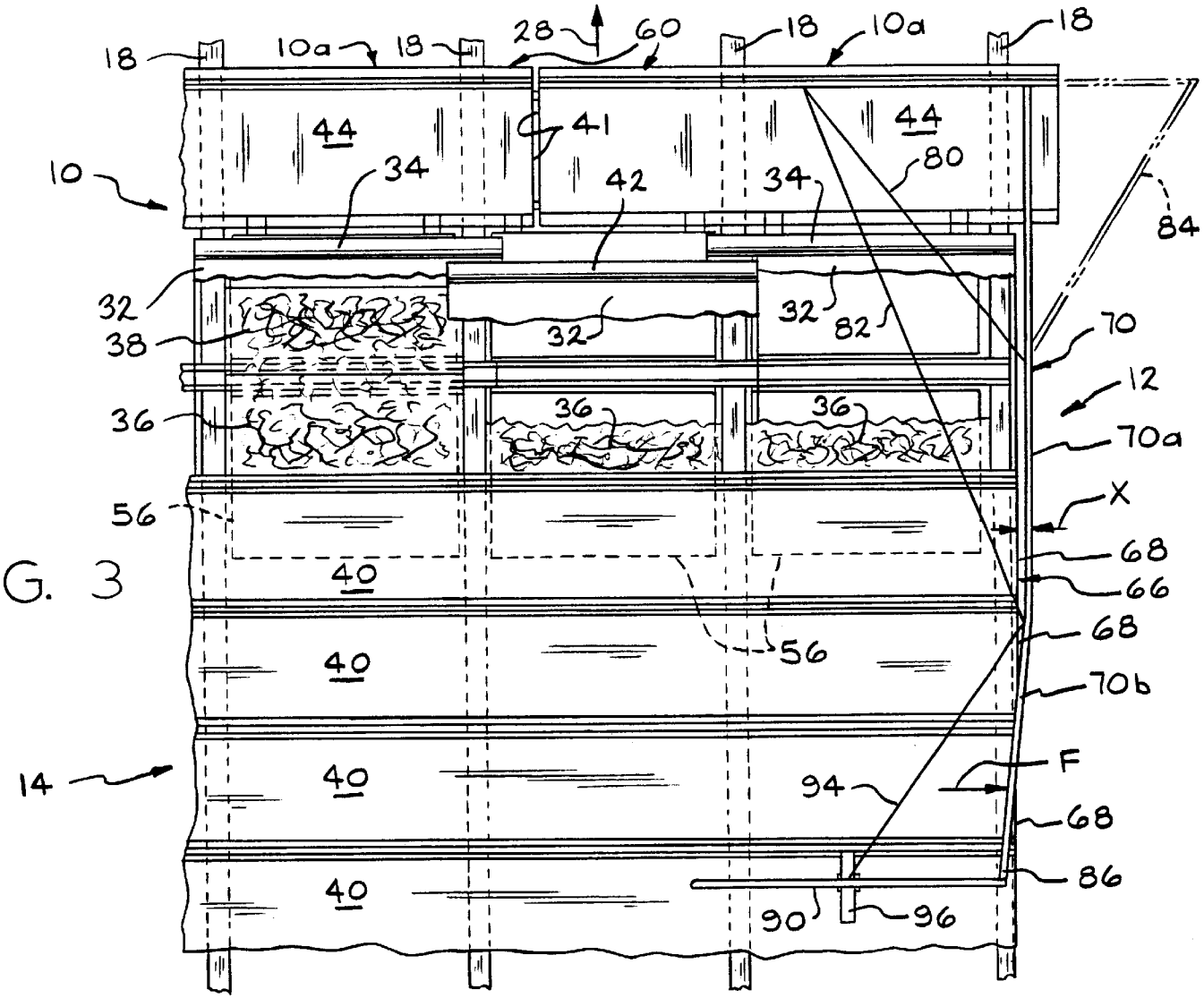
FIG. 3 is a schematic top plan view of the carriage of FIG. 2.

Referring to FIGS. 1 through 3, there is shown a carriage, indicated generally at 10, having a guardrail assembly, indicated generally at 12, in accordance with the present invention. As will be discussed in detail below, the carriage is used to construct a roof structure, indicated generally at 14, as shown in FIGS. 2, 3, and 4. The roof structure is supported by a building framework which includes main rafter beams 16 positioned parallel to each other. A plurality of purlins 18, spaced apart and arranged parallel to each other, is fastened on top of the rafters. The purlins extend in a direction normal to the rafters. The building framework may have two sloped sections (not shown) which are joined together to form a peak. The spacing of the rafter beams is typically within the range of from about 25 to about 30 feet (7.6 to about 9.1 meters) on centers. The spacing of the purlins is typically about 5 feet (1.52 meters) on centers. As best shown in FIG. 4, the purlins typically have a generally Z-shaped cross-section, and include a horizontally extending upper portion 20, a vertically extending web 22, and a horizontally extending lower portion 24. Of course, the roof structures may be constructed from bar joists or trusses, and the invention as described herein will work equally well with purlins, bar joists or trusses. The use of the term "purlins" in this specification and claims includes not only traditional purlins, but also joists, trusses, and other suitable structural members for supporting the roof structure.

The carriage 10 rides on the upper portion 20 of the purlins and travels along the length of the purlins in a downstream direction, represented by an arrow 28, as shown in FIGS. 2 and 3. Preferably, the carriage has rollers 30, rotatably mounted on the carriage, which roll along the upper portions of the purlins. As the carriage is moved, a support sheet 32 is payed out from rolls 34 and 42, as will be discussed below. The support sheet is draped on top of adjacent purlins so that the longitudinal edges of the support sheet depend from the upper portion of the purlins, as shown in FIG. 4. The support sheet supports a layer of insulation material 36 which is placed on top of the support sheet between the adjacent purlins. The insulation material is typically dispensed from a roll 38 but can be applied by any suitable manner, such as by applying elongated insulation batts on top of the support sheet. Alternatively, a layer of insulation may be placed laterally across the purlins. After the insulation material has been placed on the support sheet, long sheets of hard roofing material 40, such as metal roof decking, are then attached to the upper portion of the purlins over the support sheet and insulation. The hard roofing material can be fastened to the purlins in any suitable manner, such as by threaded fasteners or clips. The attachment of the hard roofing material presses down on the edges of the support sheet which are sandwiched between the upper portion 20 of the purlins 18 and the hard roofing material 40, so that the support sheet supports the insulation between the purlins.

Because the hard roofing material comes in long sheets, typically 30 to 35 feet (9.1 to 10.7 m), and the roofs generally have two sloped roof sides, it is customary to construct a first section of the roof structure along the width of the sloped roof side and then proceed along the length of the structure from one end to the other. The sheets of hard roofing material of the last completed section of the roof structure defines a "leading edge" of the roof structure. The workers can stand and walk on the previously attached sheets of hard roofing material to assemble the next section of roof. The carriage travels along the length of the purlins and is moved by the workers as each new section of roof is assembled.

As best shown in FIGS. 1 and 3, the carriage is comprised of a plurality of carriage sections 10*a* which are joined together. The carriage sections are joined at their respective ends 41 so that they are generally in alignment with each other, as shown in FIG. 3. The carriage sections can be joined together by any suitable manner, such as by being clamped or bolted together. Preferably, the carriage spans the entire width of the sloped section of the roof, but it can be any length up to the width of the roof itself. Note that in FIG. 3, portions of the support sheets and insulation material are removed for clarity.

To construct the roof structure 14, the carriage 10 is propelled across the purlins in the downstream direction 28. The carriage can be propelled by any suitable manner, such as pulled by a winch and cable. As the carriage moves along the length of the purlins, the longitudinal side edges of the support sheets 32 are draped across the upper portion of adjacent purlins. Preferably, the total width of the support sheet is wider than the distance between the purlins. Adjacent support sheet rolls may be positioned in a staggered and offset manner such that they are not co-linear with each other as indicated by the positioning of rolls 42 and 34 in FIG. 2. Preferably, a carriage section 10*a* covers two purlin spans, as shown in FIGS. 1 and 3. Each carriage section preferably has both a leading roll 34 and a trailing roll 42 of insulation support sheet, one roll for each of two adjacent purlin spans, as shown in FIG. 1. The edge of the support sheet from the trailing roll 42 will be draped on top of the edge of the support sheet from the leading roll 34 as the carriage moves in the downstream direction. Multiple identical carriage sections having a leading and trailing roll and can, therefore, be joined together, with every roll being staggered from an adjacent roll. Note that the rolls of support sheet 34 and 42 have been removed from the carriage 10 in FIG. 1 for clarity.

The carriage 10 can be any suitable apparatus which moves along the top of the purlins and dispenses the support sheet. As seen from FIG. 1, the carriage includes a walk platform 44 for the workers to walk or stand on while constructing the roof structure. The platform 44 preferably extends the width of the carriage to provide a continuous platform. The carriage also includes a framework 52 for rotatably mounting the rolls 34 and 42, as best shown in FIG. 2. Mounted on the framework are turning bars 54 which extend laterally across associated support sheets and are positioned slightly above the upper portions 20 of the purlins 18 so as to direct the support sheet to a generally horizontal position.

Attached to the carriage is an optional plate 56 which extends from the carriage in an upstream direction opposite the downstream direction 28. The plate supports the payed out portion of the support sheet and insulation material so that the support sheet does not drape downwardly, thereby pulling the longitudinal edges of the support sheet off the upper portion of the purlins. If sufficiently built, the plate can be used for fall protection for the workers to prevent them from falling off the leading edge of the previously completed section of roof. The plate can be attached to the carriage by any suitable means. The plate follows the carriage as the carriage moves along the length of the purlins. Preferably, the plate has wheels 58 which also support the plate by rolling along the upper portion 20 of the purlins 18. However, it is not required that the payed out support sheet be supported by the plate. The carriage could be modified so that the support sheet is payed out in such a manner that the support sheet is underneath the plate. If desired, the roll 38 of insulation material 36 could be positioned on the plate 56 above the support sheet.

The space between the vertical webs 22 of adjacent purlins 18 generally defines an insulation cavity 59, as shown in FIG. 4. The insulation cavity has a generally rectangular cross-sectional shape. The support sheet supports the insulation material in the insulation cavity. The support sheet can also be used as a vapor barrier and/or for aesthetic purposes. The support sheet can be of any suitable material for the stated purposes, such as vinyl or foil faced paper.

A shown in FIGS. 1 through 3, each of the carriage sections 10*a* preferably includes a platform railing 60 attached thereto. The platform railings extend in a lateral direction normal to the downstream direction and are positioned at the downstream edge of the platform 44. The platform railings function as a barrier from the leading edge of the roof structure for the workers on the platform. Preferably, the platform railings are made of a rigid material, such as a plurality of tubular bars welded together. Of course, the platform railings can be made of any suitable materials. The platform railings can be attached to the carriage sections by any suitable manner. For example, the platform railings can include legs 62 which are inserted into sockets 64 attached to the walk platform 44.

As shown in FIG. 3, the roof structure 14 has a lateral edge 66 generally defined by ends 68 of the sheets of roofing material 40. The guardrail assembly 12 protects the workers from inadvertently going past the lateral edge 66 of the roof structure. Preferably, a guardrail assembly 12 is located next to each end of the carriage 10 which is positioned adjacent a lateral edge 66 of the roof structure. The guardrail assembly 12 includes an edge railing 70 extending in a direction generally parallel to the downstream direction and the lateral edge of the roof structure. Of course, the edge railing does not have to extend exactly parallel to the lateral edge of the roof structure but can be, for example, angled inwardly towards the roof structure so that the edge railing still provides protection for the workers. The edge railing 70 is positioned along the roof structure generally above the fastened sheets of hard roofing material. However, the edge railing does not have to be positioned directly above the sheets of hard roofing material but can be positioned slightly beyond the lateral edge of the roof structure. To reduce the size of the edge railing for transportation and installation, the edge railing 70 is preferably formed by joining a first section 70*a* with a second section 70*b*. As shown in FIG. 3, the second section 70*b* is positioned at an angle with respect to the first section 70*a*, the reason for which will be explained below.

The edge railing 70 can be made of any suitably rigid material, such as a plurality of tubular metal bars welded together. The edge railing can be attached to the carriage by any suitable manner. In the embodiment of the edge railing illustrated in FIG. 1, the first section 70*a* of the edge railing has a first leg 72 which is received in a socket 74 fastened to the platform 44 of the carriage 10. The first section 70*a* further includes a second leg 76 received in a socket 78 fastened to the plate 56 of the carriage. The second section 70*b* is attached to the first section 70*a* and cantilevered therefrom.

Preferably, the sockets 74 and 78 are adjustably fastened to respective portions of the carriage 10 so that the guardrail assembly 12 can be positioned at any desirable location on the carriage 10. For example, since each carriage section 10*a* spans across two purlin spans or two insulation cavities 59, the last carriage section 10*a* at the edge of the roof might extend past the lateral edge 66 of the roof by half its width, for example, if the carriage 10 spans across an odd number of insulation cavities 59. For this situation, it would be desirable to position the edge railing generally in the middle of the last carriage section 10*a* adjacent the lateral edge 66 of the roof structure. The sockets 74 and 78 can be adjustably fastened to the carriage 10 at the desired positions to properly position the side railing 70. The sockets 74 and 78 can be adjustably fastened to the carriage by any suitable manner, such as by removable clamps or by bolting the carriage in one of a plurality of spaced bolt holes.

Preferably, the edge railing 70 is positioned from the lateral edge 66 of the roof structure by a relatively short distance so that the edge railing does not severely interfere with the assembling of the roof structure, while still functioning as a barrier for the workers. For example, the edge railing is preferably spaced from the lateral edge of the roof structure by a distance less than one meter, and more preferably, by a distance less than 0.3 meters. In the embodiment of the edge railing 70 illustrated in FIG. 3, the first section 70*a* is spaced a distance X beyond the lateral edge 66. By positioning the edge railing slightly beyond or outside the lateral edge 66, the sheets of hard roofing material 40 can be placed in position without interference from the edge Is railing. Preferably, the distance X between the edge railing 70 and the lateral edge 66 of the roof structure is small enough to prevent a worker from inadvertently slipping between the edge railing and the lateral edge of the roof structure.

To provide stability for the edge railing 70, it can be supported by support members 80 and 82. The support member 80 is attached to and extends from the platform railing 60 and the first section 70*a* of the edge railing 70. The support member 82 is attached to and extends from the platform railing 60 and the second section 70*b* of the edge railing 70. The support members 80 and 82 can be attached to the railings by any suitable manner, such as by clamps (not shown). The support members 80 and 82 help prevent the edge railing 70 from moving in a lateral direction normal to the downstream direction when a force F, as shown in FIG. 3, is applied to the edge railing in a direction away from the roof structure. The force F represents a lateral force which can be applied to the edge railing, such as by a worker leaning against the edge railing. Note that the cables 80 and 82 are in tension when the force F is applied to the edge railing. The support members 80 and 82 can be any suitable structural member, such as cable or lengths of metal bars, which help support the edge railing 70 from moving in the lateral direction, as described above. The guardrail assembly 12 can include support members which resist a compressive force to help prevent the edge railing 70 from moving in a lateral direction when the force F is applied to the edge railing. For example, the guardrail assembly 12 can include a framework, indicated by phantom lines 84 in FIG. 3, attached to the platform railing 60 and the edge railing 70. The framework 84 is positioned on the outer side of the edge railing away from the roof structure 10, as shown in FIG. 3.

Preferably, the second section 70*b* of the edge railing 70 extends at a slight angle from the first section 70*a* of the edge railing so that an end 86 of the second section 70*b* is positioned directly above the sheets of hard roofing material instead of being at the distance X from the lateral edge of the roof structure. If the edge railing 70 is deflected outwardly by a Force F, the positioning of the end 86 of the second section 70*b* provides extra clearance so that the edge railing does not extend too far from the lateral edge of the roof structure. For example, if the end 86 of the second section 70*b* is spaced 0.1 meters from the lateral edge 66, the end 86 of the edge railing 70 can still be deflected by 0.1 meters before the end 86 extends beyond the lateral edge. The angle between the first section 70*a* and the second section 70*b* can be any suitable angle sufficient to position the end 86 over the hard roofing material. Preferably, the angle is within the range of from about 5 to about 30 degrees.

The guardrail assembly 12 can also include an optional back railing 90, as illustrated in FIGS. 1 through 3. The back railing 90 is attached to the end 86 of the second section 70*b* of the edge railing 70 and extends at an angle from the first or downstream direction 28. Preferably, the back railing extends in a lateral direction normal to the downstream direction 28. The back railing can be made of any suitably rigid material, such as a plurality of tubular metal bars welded together. The back railing 90 can be supported in a similar manner as the edge railing 70, such as by a cable 94. The back railing 90, the edge railing 70, and the platform railing 60 cooperate to contain or corral the workers working along the lateral edge of the roofing structure into a secure working zone defined between the railings 60, 70, and 90. Thus, the workers within this secure working zone may not need to be tied off to the roof structure.

The guardrail assembly 12 can include a roller 96 rotatably mounted thereon to provide vertical support for the edge railing 70 and the back railing 90. In the embodiment of the guardrail assembly 12 illustrated in FIGS. 1 through 3, the roller 96 is mounted on the back railing 90. Of course, the roller can be mounted on the edge railing 70 if desired. As the guardrail assembly 12 travels along the roof structure, the roller simply rolls along the top surface of the sheets of roofing material 40. Preferably, the diameter of the roller is large enough so that the roller will not become obstructed by laterally extending ridges formed on the sheets of roofing material 40. Multiple rollers may also be used. Instead of a roller, the guardrail assembly can have any other suitable support member which vertically supports the guardrail assembly and allows the guardrail assembly to move horizontally along the roof structure, such has for example, a slide member.

The roller 96 provides vertical support for the edge railing 70 and the back railing 90. Alternatively, the edge railing and back railing can be supported by tension members (not shown) to help vertically support the cantilevered second section 70*b* and back railing 90. For example, the second leg 76 of the edge railing can be extended upward. A tension member can be connected to the extended upper end of the second leg 76 to an upper portion of the end 86 of the second section 70*b*.

The edge railing 70 and the back railing can be any desired length. Preferably, the edge railing is between 3 to 6 meters in length, and the back railing is preferably greater than 2 meters in length.

Although the guardrail assembly 12 was described and shown as connected to the carriage 10, it should be understood that the guardrail assembly 12, and in particular the edge railing 70, can be used without the carriage 10 for protecting workers along the lateral edge 66 of the roof structure. For example, the guardrail assembly 12 can be configured to travel along the roof structure, such as along the purlin along the lateral edge of the roof structure. Protection for the workers can also be provided by a netting material (not shown) which is placed over the purlins and eventually is placed underneath the sheets of roofing material as they are fastened to the top portions of the purlins.

The principle and mode of operation of this invention have been described in its preferred embodiments. However, it should be noted that this invention may be practiced otherwise than as specifically illustrated and described without departing from its scope.

What is claimed is:

1. In combination:

1) a roof structure including;

a plurality of purlins spaced apart from one another in a parallel arrangement; and sheets of roofing material fastened to said purlins, said sheets having ends which define an edge of said roof structure, said edge extending in a first direction; and 2) a guardrail assembly movable along said roof structure in said first direction, said guardrail assembly including a railing positioned generally above said sheets of roofing material and extending generally in said first direction.

2. The combination of claim 1, wherein said railing is spaced from said edge of said roof structure by a distance less than one meter.

3. The combination of claim 1, wherein said guardrail assembly further includes a second railing extending in a second direction angled from said first direction.

4. The combination of claim 3, wherein said railing is supported from moving in said second direction by a support member fastened between said railing and said second railing.

5. The combination of claim 4, wherein said support member is a rigid bar.

6. The combination of claim 3, wherein said railing is formed of multiple rigid railing sections fastened together, and wherein each railing section is supported from moving in said second direction by a respective support member fastened to said second railing and said respective railing section.

7. The combination of claim 3, wherein said guardrail assembly further includes a third railing extending in said second direction, such that said railing extends between said second and third railings.

8. The combination of claim 1, wherein said railing is supported vertically by a roller attached to said railing, said roller adapted to roll on top of the sheets of roofing material.

9. The combination of claim 1, wherein said railing includes first and second sections, and wherein said first section extends in said first direction, and said second section extends at an angle from said first section.

10. The combination of claim 9, wherein said first section is positioned above said sheets of roofing material beyond said edge of said roof structure, and wherein said second section has first and second ends, said first end being connected to said first section, and said second end being positioned directly above said sheets of roofing material.

11. In combination:

1) a roof structure including;

a plurality of purlins spaced apart from one another in a parallel arrangement; and sheets of roofing material fastened to said purlins, said sheets having ends which define an edge of said roof structure, said edge extending in a first direction; and 2) a carriage movable along the roof structure, said carriage having a roll of support sheet mounted thereon, wherein the support sheet has side edges which are generally aligned with the top portions of adjacent purlins; and 3) a guardrail assembly attached to said carriage, said guardrail assembly including a railing positioned above said sheets of roofing material and extending generally in said first direction.

12. The combination of claim 11, wherein said carriage further includes a generally horizontal platform and a platform railing fastened to said platform, said platform railing extending in a lateral direction normal to said first direction.

13. The combination of claim 11, wherein said railing is spaced from said edge of said roof structure by a distance less than one meter.

14. The combination of claim 11, wherein said guardrail assembly further includes a second railing extending in a second direction angled from said first direction.

15. The combination of claim 14, wherein said second direction is normal to said first direction.

16. The combination of claim 14, wherein said railing is supported from moving in said second direction by a support member fastened between said railing and said second railing.

17. The combination of claim 16, wherein said support member is a cable.

18. The combination of claim 14, wherein said railing is formed of multiple rigid railing sections fastened together, and wherein each railing sections is supported from moving in said second direction by a respective support member fastened to said second railing and said respective railing section.

19. The combination of claim 14, wherein said guardrail assembly further includes a third railing extending in said second direction, such that said railing extends between said second and third railings.

20. A method of providing a roof structure having a plurality of purlins spaced apart from one another in a parallel arrangement and extending in a first direction, the method comprising the steps of:

a. providing a carriage upon which is mounted a roll of support sheet, wherein the support sheet has side edges which are generally aligned with top portions of adjacent purlins;

b. providing a guardrail assembly attached to the carriage, the guardrail assembly including a railing extending in the first direction;

c. completing a first section of the roof structure comprising purlins, the support sheet, insulation material placed on top of the support sheet, and a first sheet of roofing material fastened to the purlins;

d. positioning the railing above the first sheet of roofing material;

e. moving the carriage and the guardrail assembly along the length of the purlins in a direction away from the completed first section of the roof structure; and f. completing a second section of the roof structure comprising purlins, the support sheet, insulation material placed on top of the support sheet, and a second sheet of roofing material fastened to the purlins, adjacent the first section of the roof structure.

* * * * *